US006360464B1

(12) United States Patent
Tate

(10) Patent No.: US 6,360,464 B1
(45) Date of Patent: Mar. 26, 2002

(54) MAGNETIC PRODUCT DISPLAY

(76) Inventor: John R. Tate, 11621 Markon Dr., Garden Grove, CA (US) 92841

( * ) Notice: Subject to any disclaimer, the term of this patent is extended or adjusted under 35 U.S.C. 154(b) by 0 days.

(21) Appl. No.: 09/556,156

(22) Filed: Apr. 21, 2000

(51) Int. Cl.[7] ..... G09F 7/04

(52) U.S. Cl. ..... 40/621; 40/722; 248/441.1; 248/461

(58) Field of Search ..... 40/621, 600, 721–723, 40/745; 428/182; 248/441.1, 461

(56) References Cited

U.S. PATENT DOCUMENTS

| | | | | | |
|---|---|---|---|---|---|
| 333,203 | A | * | 12/1885 | Dick | 248/441.1 |
| 1,531,070 | A | * | 3/1925 | Bruns | 40/600 |
| 3,973,341 | A | * | 8/1976 | Kent, Jr. | 40/539 |
| 4,228,209 | A | * | 10/1980 | Chanvannes | 428/182 |
| 4,856,213 | A | * | 8/1989 | Hord | 40/721 |
| 5,307,580 | A | * | 5/1994 | Farmer | 40/606 |

FOREIGN PATENT DOCUMENTS

| | | | | |
|---|---|---|---|---|
| CA | 760159 | * | 6/1967 | 40/621 |

* cited by examiner

*Primary Examiner*—Cassandra H. Davis
(74) *Attorney, Agent, or Firm*—Charles H. Thomas

(57) ABSTRACT

A sales display device is formed as a thin, flat, magnetically inert panel disposed in an upright disposition. The panel has embedded therewithin a plurality of ferrous articles located at uniform intervals across the display surface of the display panel and concealed from view. Preferably, a positioning sheet is employed with positioning openings defined therethrough. The positioning sheet is located directly against the front surface of the display panel. Magnetic articles, such as magnetic ball marker attracting patches, golf divot tools bearing magnets, golf ball markers having magnets therein, and other small objects containing one or more magnets can be displayed on the display device merely by bringing the magnetic articles into contact with the display board at the positioning openings defined therein. The force of magnetic attraction of the small magnetic articles offered for sale acts through the front surface of the display board and holds the magnetic articles against that surface until purposefully removed therefrom. The magnetic articles are held on the upright surface without any visible means of support. The sales display of the invention is particularly useful for displaying magnetic ball marker attracting patches, golf ball markers having magnets therewithin, and golf divot repair tools that employ magnets.

10 Claims, 4 Drawing Sheets

MAGNETIC PRODUCT DISPLAY

BACKGROUND OF THE INVENTION

1. Field of the Invention

The present invention relates to a device for attractively and conveniently displaying small articles containing magnets for sale.

2. Description of the Prior Art

In the retail sales trade at establishments at which customers and prospective customers are presented with small items offered for sale, a need has existed for displaying such articles in a manner wherein a small article can be closely examined without the necessity for expensive packaging and packaging that, at least in part, makes the article difficult to view. One class of small devices which may be offered for sale in a variety of attractive displays are articles containing magnets. For example, in the sport of golf, divot repair tools, ball markers, and other devices containing magnets are often offered for sale at golf club pro shops, souvenir kiosks, and other similar locations that are subject to a high volume of customer traffic.

In the past, even devices containing magnets have typically been packaged in conventional packaging, such as blister packages, plastic boxes, clear plastic bags suspended from header cards, and other conventional types of packaging. However, for low cost items such as divot tools, magnetic ball markers, and other similar devices, the cost of conventional packaging represents a considerable portion of the cost of marketing the article.

SUMMARY OF THE INVENTION

The present invention involves a unique, attractive, yet very simply constructed device for displaying small articles containing magnets. The magnetic product display of the invention is advantageous over many conventional systems for displaying small magnetic articles for sale in that the display of the invention allows the product to be viewed without any covering between the product and the observer. That is, the observer need not look through a layer of transparent or translucent plastic in order to see the product. To the contrary, the product bearing the magnet is displayed to a prospective customer in such a way that the customer can touch, feel, handle, and closely examine the device. This is particularly advantageous in the marketing of small articles containing magnets, since, if such articles are mounted in blister cards or in packages, they cannot be freely handled by a customer and the magnetic properties of such articles cannot be tested by a prospective purchaser.

A further advantage of the display system of the invention is that it can be fabricated extremely economically. According to the system of the invention, a flat display panel is fabricated from a magnetically inert material. The display panel has a product display area and is disposed in an upright condition. The display panel can either be hung on a wall or some other vertical support, or it can be supported in an upright position, either in a vertical plane, or more typically, in an upwardly inclined plane. The display panel is equipped with a plurality of small ferrous elements that are incorporated into the structure of the display panel such that a magnetic force of a small article containing a magnet acts through a concealing front surface of the panel. The ferrous elements in the display panel attract articles containing magnets and draw them into contact with and hold them against the front display face of the panel. The ferrous elements are separated from the products bearing magnets which are displayed for sale by only a very thin layer of plastic or paper.

The display panel of the invention is extremely easy to fabricate. For example, the display panel may be formed of a sheet of corrugated paperboard in which a layer of paper is permanently deformed into a series of mutually parallel corrugations and sandwiched in between two flat sheets located on each of the opposite sides of the corrugated sheet. Adhesive on the interior surfaces of the flat sheets or on the corrugated sheet ensures that the corrugated sheet is firmly and permanently attached to the flat sheets due to the adhesive bond between the crests of the corrugations and the inwardly facing surfaces of the covering front and back sheets.

The construction of the corrugated paperboard display panel of the invention utilizes the same corrugated paperboard stock that is used to fabricate paperboard boxes for packaging and shipping innumerable different articles. The corrugations extend in mutually parallel disposition to each other between the covering front and back flat layers of paper to thereby define a multiplicity of tunnels within the display panel structure.

In conventional paperboard boxes, the corrugations are formed to provide the paperboard box walls with a certain stiffness. However, this construction has the advantage in that a multiplicity of concealed channels or tubes are defined within a generally flat paperboard wall having front and back surfaces between which the layer of corrugated paper is disposed.

The tubular channels or tunnels within a corrugated paperboard structure of this type are ideally suited to receive thin, straight lengths of ferrous wire. That is, steel wires can be inserted into some of the tunnels or channels within the corrugated paperboard display panel so that the wires are totally concealed from view. Nevertheless, they are attracted by the magnetic fields of small articles carrying magnets that act through the front, display surface of the display panel.

The present invention provides a convenient and very economical system for displaying small articles containing magnets. The magnetic articles, such as magnetic golf ball markers and golf divot tools containing magnets are merely placed against the front display surface of the flat display panel. The magnetic fields of the magnets act through the thin, front paper surface of the flat display panel, thus attracting the magnets and the devices to which they are attached against and into contact with the display panel. The magnet field of each magnetic article is sufficiently strong so that the small article containing the magnet is held in position against the front display surface of the panel, even though the panel is inclined at a very steep angle, or even in a vertical position.

Because the corrugations formed in conventional paperboard structures provide the necessary channels for inserting the steel wires into the display panel, no special construction or expensive fabrication of the device is required. Quite to the contrary, the display of the invention can be fabricated from conventional, corrugated paperboard sheet stock and a thin, steel wire.

In one broad aspect the invention may be considered to be a display for exhibiting an array of magnetic products. The display is comprised of a flat display panel constructed of a magnetically inert material and having a product display area, a support for holding the display panel in an upright disposition, and a plurality of ferrous elements incorporated into the display panel and located across the product display area.

Preferably the display panel is comprised of a sheet of corrugated paperboard that defines a multiplicity of mutually parallel, concealed tunnels therewithin. The ferrous elements are preferably comprised of straight lengths of steel wire inserted into at least some of the tunnels. Typically, the steel wires are inserted into less than all of the tunnels in the sheet of corrugated paperboard. The steel wires are spaced apart an appropriate distance. This reduces the amount of steel wire required and also allows some lateral separation between the magnetic articles to be displayed on the display panel.

Preferably, each of the steel wires is located at a uniform, spaced distance from other adjacent steel wires. Typically, the steel wires may be spaced apart a distance of about one and one-half inches to allow the display of golf divot repair tools that contain magnets therewithin.

In a preferred embodiment of the invention a positioning sheet is disposed against the front display surface of the display panel. The positioning sheet has an array of article positioning openings defined therethrough at uniform, repeating intervals from each other. The positioning sheet is overlaid upon the flat display panel so that the article positioning openings reside in registration with the steel wires in the tunnels.

While the display sheet can be hung vertically utilizing a picture hanging apparatus, more typically the support of the display is a stand located behind the flat display panel. The stand holds the display panel in an upright disposition upon a flat horizontal surface, typically at an angle of about seventy degrees relative to horizontal. The stand may also conveniently include an inventory container such as a box or tray to hold a supply of the magnetic products for replenishing the magnetic products as they are sold and removed from the article positioning openings.

In another broad aspect the invention may be considered to be a display device for releaseably holding magnetic articles aloft for display, typically in a retail sales display. The display device includes an thin, flat, expansive, magnetically inert display board having a front display surface; a support for holding the display board at an angle of at least forty-five degrees relative to horizontal; and a plurality of ferrous member located within the display board behind the front display surface. In this way, when magnetic articles are placed in contact with the front display surface, they will adhere thereto due to the force of magnetic attraction of the magnetic articles to the ferrous members through the front display surface.

In still another broad aspect the invention may be considered to be a sales display comprising: a magnetically inert display panel having a display surface with an exposed area large enough to display a multiplicity of magnetized articles, a support for holding the display surface at an upright orientation, and at least one ferrous article embedded in the display surface and concealed behind the exposed area of the display surface.

The invention may be described with greater clarity and particularity by reference to the accompanying drawings.

DESCRIPTION OF THE EMBODIMENT

Figure 1:
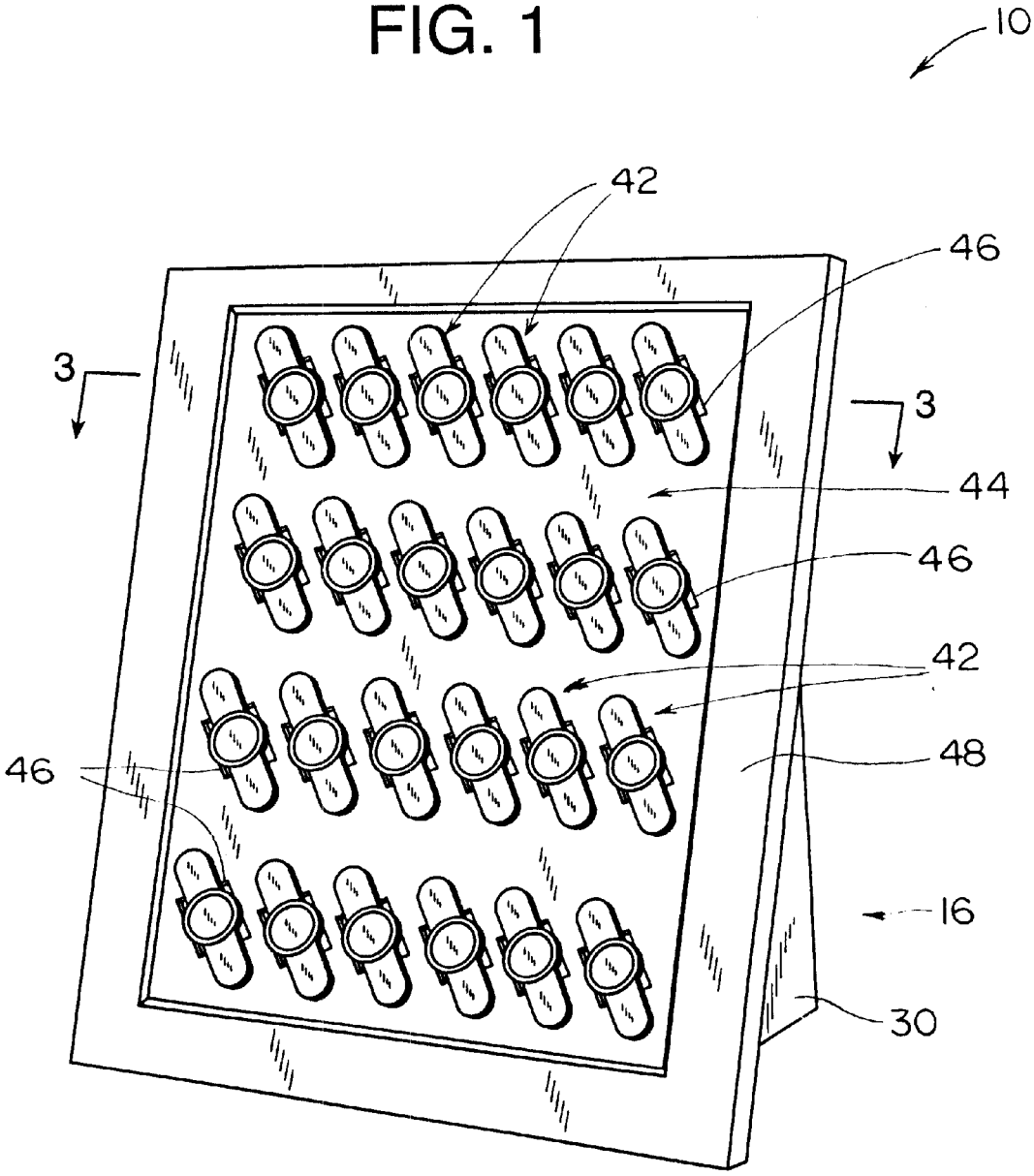
FIG. 1 is a front perspective view of one preferred embodiment of the sales display of the invention.

FIG. 1 illustrates a sales display 10 of a type adapted to rest upon a horizontal surface. The sales display 10 includes a flat, rectangular display panel 12, which is visible in FIG. 3, a frame 14, and a support in the form of a stand 16. The display panel 12 is formed of paperboard in which a corrugated paper sheet 18 is disposed between and secured to a thin, flat, expansive front sheet of paper 20 and similar back sheet of paper 22. The display panel 12 is cut from conventional corrugated paperboard stock and has a flat, rectangular shape. The paper sheets 20 and 22 are secured to the crests of the corrugations formed by the corrugated paper sheet 18 by conventional adhesive so that the corrugated piece of paper 18, together with the flat front and back sheets 20 and 22 form a multiplicity of mutually parallel, elongated tunnels 24 that are concealed from view by the front and back sheets of paper 20 and 22 and by the edges of the frame 14 in the finished sales display 10.

The elongated channels or tunnels 24 extend from the top edge to the bottom edge of the display panel 12. In the embodiment illustrated, a plurality of ferrous members in the form of lengths of steel wire 28 are disposed within some of the tunnels 24 and extend throughout the length of the display panel 12. In the embodiment shown, the lengths of steel wire 28 are straight and are inserted into every fourth tunnel and concealed from view by the front and back sheets 20 and 22 and by the top and bottom edges of the frame 14.

The front sheet 20 forms a front display surface for the thin, flat, expansive display panel 12. The stand 16 is also formed of corrugated paperboard and defines a pair of legs 30 and 32 that are joined together at their upper and lower ends by transverse webs 34 and 36. The stand is thereby formed into a generally U-shaped configuration with the webs 34 and 36 secured by adhesive to the back side of the frame 14. The legs 30 and 32 of the stand 16 are located behind the frame 14 and are both oriented generally perpendicular to the plane of the display panel 12. The central portion of the stand 16 is die cut to form a stiffening panel 38 that is slit slightly at laterally spaced locations to fit into corresponding slits in the legs 30 and 32. The stiffening panel 38 is also oriented perpendicular to the display panel 12 and also perpendicular to the legs 30 and 32. The short slits in the stiffening panel and in the legs serve to hold the legs 30 and 32 in a mutually parallel disposition relative to each other and projecting outwardly from the back side of the frame 14. The legs 30 and 32 are configured to hold the display panel 12 at an angle relative to horizontal of at least forty-five degrees, and preferably about seventy degrees.

Figure 2:
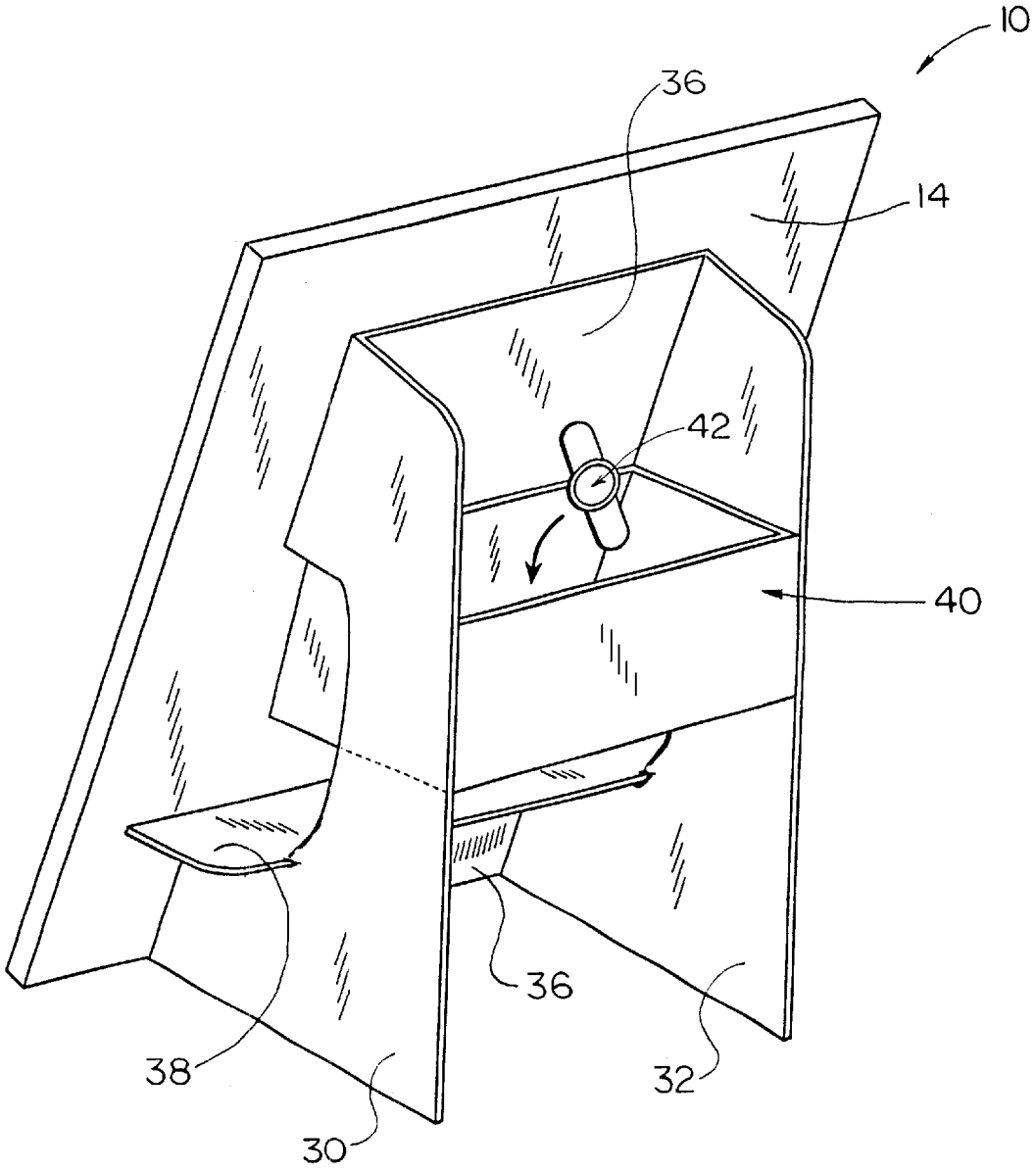
FIG. 2 is a rear perspective view of the sales display of FIG. 1.
Figure 3:
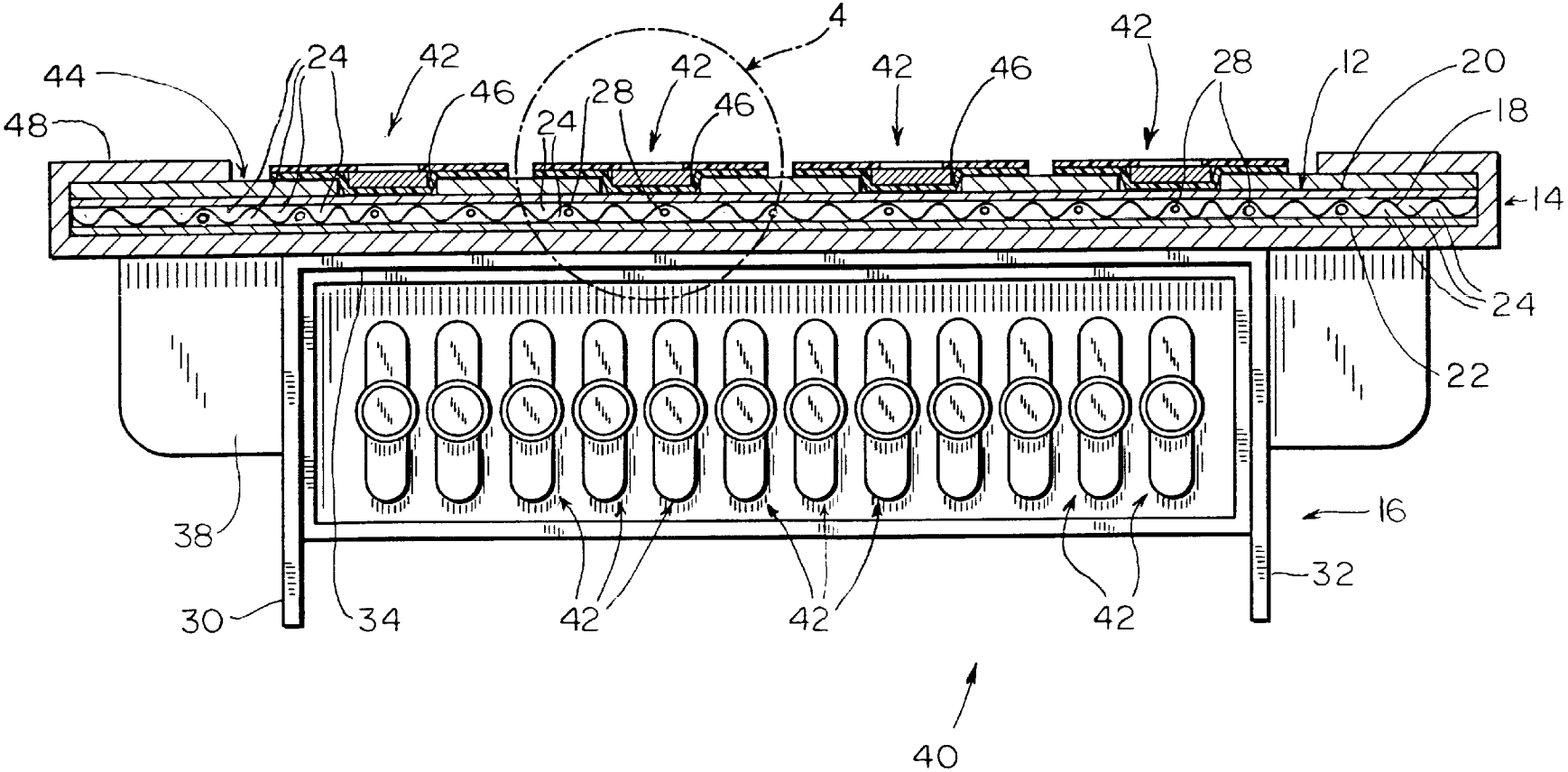
FIG. 3 is a sectional plan view taken along the lines 3—3 of the sales display of FIG. 1.

As best illustrated in FIGS. 2 and 3, the stand 16 is also formed with a box-like inventory container 40, also constructed of corrugated paperboard. The inventory container 40 has four sides and a floor and is provided for holding a supply of magnetic products 42. Each of the magnetic products 42 may, for example, be a device in the nature of a patch having opposing wings bearing adhesive that is initially covered by a conforming sheet of paper or plastic covered with a release agent. The patch defines within its structure a cavity within which a disc-shaped magnet is permanently secured. Each patch 42 is designed to be secured on the inside surface of a fabric layer of golfer's clothing, such as hat, shirt, visor, or some other article of clothing that is worn by the golfer. When in use the patch exerts a magnetic force that acts through the fabric layer against which the patch is attached to attract a steel ball marker. If moved into the vicinity of the area of the fabric against which the patch 42 is placed, the ball marker will be drawn by magnetic force against the exposed exterior surface of the golf hat or other article of clothing, and thus remain in adhering relationship therewith without any visible means of support. The nature and use of the patches 42 are more fully described in my prior, copending U.S. patent application Ser. No. 09/336,072 now U.S. Pat. No. 6,163,889 filed Jun. 18, 1999, which is incorporated by reference herein in its entirety.

The display 10 is also provided with a thin, broad, rectangular-shaped positioning sheet 44 that resides in contact with the front surface of the display board 12 that is formed by the front sheet 20 thereof. The positioning sheet 44 has an array of a multiplicity of rectangular article positioning openings 46 defined therethrough at uniform, repeating intervals from each other. The positioning sheet 44 is overlaid upon the flat display board or panel 12 so that the article positioning openings 46 reside in registration with the steel wires 28 in the tunnels 24. The rectangular positioning openings 46 are arranged over the surface of the positioning sheet 44 in a rectilinear array at lateral intervals from each other that correspond to the distances between the parallel steel wires 28 that are embedded within the display panel 12. In a preferred embodiment of the invention, the display openings 46 are spaced from each other, center-to-center, a distance of about one and a half inches in a lateral direction and a distance of about three inches, center-to-center, in a direction parallel to the height of the display panel 12.

The rectilinear array of article positioning openings 46 in the positioning sheet 44 guides the placement of the magnetic articles 42 on the front sheet 20 of the display panel 12. The article positioning openings 46 are positioned in registration with the tunnels 24 in which the steel wires 28 are embedded. That is, the center of each article positioning opening 46 lies at a location on the sheet 20 directly behind which one of the steel wires 28 is inserted.

Figure 4:
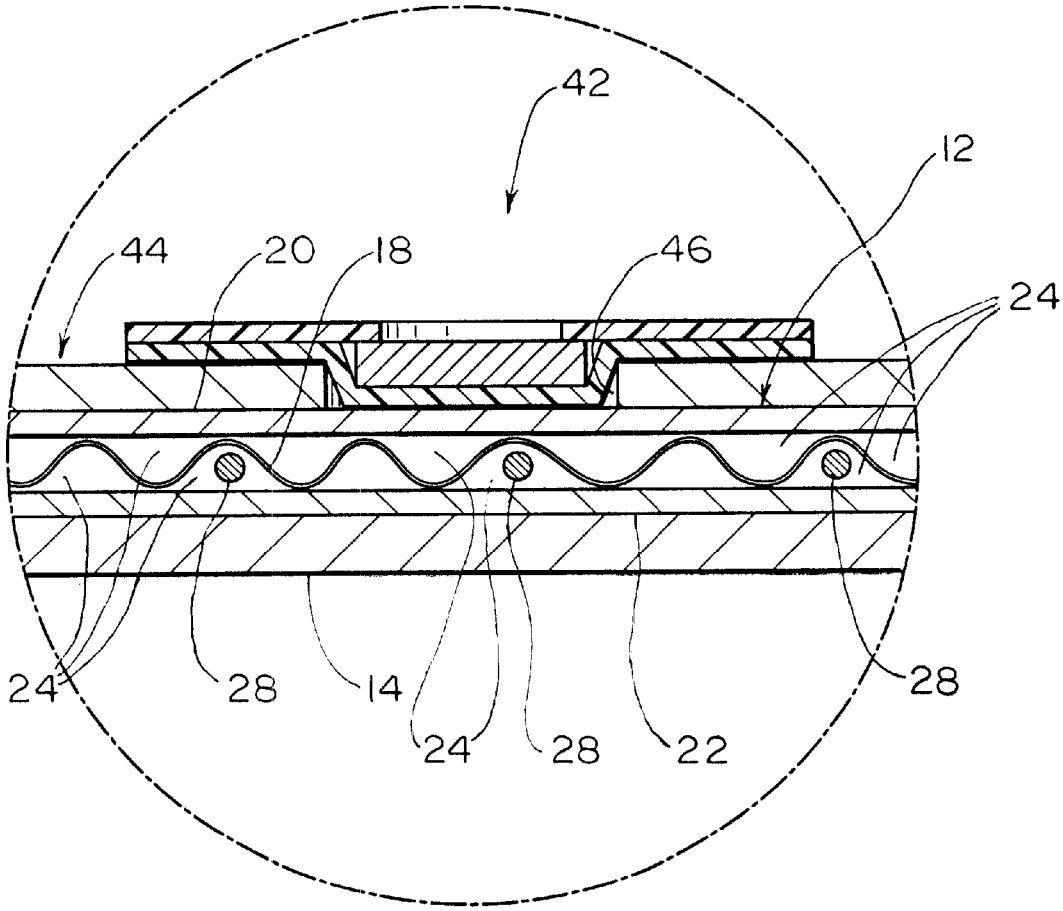
FIG. 4 is a sectional detail taken from FIG. 3.

When small magnetic articles, such as the magnetic patches 42 are placed in contact with the front display surface of the display board 12 at the article positioning openings 46 in the article positioning sheet 44, they will adhere thereto due to the magnetic force exerted by the magnetic articles 42 upon the steel wires 28 located closest thereto, as best illustrated in FIG. 4. When the magnetic patches 42 are placed in contact with the front display surface of the sheet 20, they will adhere thereto due to the force of magnetic attraction to the ferrous steel wires 28, since the magnetic field of each of the magnets in the articles 42 is strong enough to act through the magnetically inert front sheet 20 of the display 12.

The display device 10 is typically located at a point of sale within a retail establishment at which impulse items are often sold. For example, the display 10 may be located upon a counter near a cash register. If a purchaser wishes to buy one of the magnetic articles 42, the selected article 42 can be easily lifted from the display board 12 by merely grasping one of its ends and pulling the selected magnetic patch 42 away from the display board 10 so that the magnetic field exerted by the magnetic article 42 is no longer proximate to any of the steel wires 28.

The article positioning openings 46 in the article positioning sheet 44 are further advantageous in that when the magnetic articles 42 are positioned in the openings 46, each magnetic article 42 will be located a uniform, discrete distance from the neighboring magnetic articles 42. This prevents the magnetic articles 42 from contacting each other so that they do not cling together in a chain. Also, the openings 46 provide an attractive and convenient display matrix so that a shop keeper may readily replenish the magnetic products 42 as they are sold and removed from the article positioning openings 46. The inventory container box 40 holds a supply of the magnetic products 42 specifically as a source of replenishment for the positioning openings 46 as the magnetic articles are sold and removed therefrom.

The frame 14 is formed of a sheet of paperboard, cloth, or other cheap stock that covers the entire back surface of the back sheet 22 of the display 12. The edges of the frame 14 are wrapped around the edges of the display board 12 and cover the periphery of the positioning sheet 44. The frame 14 thereby forms an open, rectangular border 48 about the display area of the display board 10.

The stand 16 holds the display board 12 atop a flat, horizontal surface at an upward inclination relative thereto. A plurality of the ferrous steel wires 28 are located within the display panel 12 behind the front display surface formed by the front sheet 20. When the magnetic articles 42 are placed in contact with the front display surface of the front sheet 20, they will adhere thereto due to the force of magnetic attraction of the magnetic articles 42 to the ferrous steel wires 28 through the front display surface sheet 20.

Undoubtedly, numerous variations and modifications of the invention will become readily apparent to those familiar with the display of small magnetic articles. The invention can be utilized with magnetic articles other than the magnetic patches 42. For example, the display 10 can be utilized to display small timers having magnetic bases, golf divot repair tools that contain magnets, and any other small articles each containing a magnet. Also, the ferrous articles embedded in the display panel 10 do not necessarily need to take the form of steel wires. To the contrary, small steel wafers could be utilized and embedded within the display panel 10 in place of the wires. Also, the display could incorporate a single, flat, steel sheet that extends across the entire area at which magnetic articles are to be displayed. Other embodiments of the invention may be employed as well.

Accordingly, the scope of the invention should not be construed as limited to the specific embodiment illustrated and described.

What is claimed is:

1. A product display comprising:

a display panel constructed of a magnetically inert material and having a product display area, a support for holding said display panel in an upright disposition, and a plurality of ferrous elements incorporated into said display panel throughout and located across said product display area, and wherein said display panel is comprised of a sheet of corrugated paperboard that defines a multiplicity of mutually parallel, concealed tunnels therewithin, and said ferrous elements are comprised of lengths of straight, steel wire inserted into at least some of said tunnels, and at least one magnetic product adhering to said display panel by the force of magnetic attraction.

2. A display according to claim 1 wherein said steel wires are inserted into less than all of said tunnels in said sheet of corrugated paperboard.

3. A display according to claim 2 wherein each of said steel wires is located at a uniform, spaced distance from other adjacent steel wires.

4. A display according to claim 3 further comprising a positioning sheet having an array of article positioning openings defined therethrough at uniform, repeating intervals from each other, and said positioning sheet is overlaid upon said display panel so that said article positioning openings reside in registration with said steel wires.

5. A display according to claim 1 wherein said support is a stand located behind said display panel and which holds said display panel in an upright disposition upon a horizontal surface, and said stand includes an inventory container to hold a supply of said magnetic products.

6. A display device for releaseably holding at least one magnetic article aloft for display comprising: a thin, expansive, magnetically inert display board having a front display surface; a support for holding said display board at an angle of at least forty-five degrees relative to horizontal; and a plurality of ferrous members located within said display board behind said front display surface, said at least one magnetic article are placed in contact with said front display surface and adheres thereto due to the force of magnetic attraction through said front display surface of said at least one magnetic article to said ferrous members, and wherein said display board is formed of paperboard in which a sheet of corrugated paper is disposed between and secured to flat front and back sheets to define a multiplicity of mutually parallel, elongated tunnels between said front and back sheets, and said ferrous members are lengths of steel wire inserted into some of said tunnels and concealed from view by said front and back sheet.

7. A display device according to claim 6 further comprising a positioning sheet disposed atop said front sheet of said display board and defining a multiplicity of article positioning openings therethrough to guide placement of said at least one magnetic article on said front sheet of said display board, and said article positioning openings are positioned in registration with said some of said tunnels in which said steel wires are inserted.

8. A display device according to claim 6 wherein said support is a stand which holds said display board atop a flat horizontal surface at an upward inclination relative thereto, and further comprising an article storage box located on said stand behind said display board for storing an inventory of said at least one magnetic article.

9. A sales display comprising:

a magnetically inert display panel formed of corrugated paperboard that defines a multiplicity of mutually parallel concealed tunnels therewithin, and having a display surface with an exposed area large enough to display a at least one of magnetized article, a support for holding said display surface at an upright orientation, at least one steel wire disposed in one of said concealed tunnels so as to be embedded in said display panel and concealed behind said exposed area of said display surface, said at least one magnetized article adhering to said display panel the force of magnetic attraction.

10. A sales display according to claim 9 and further comprising: plurality of said wires embedded in said display panel and concealed behind said exposed area of said display surface as aforesaid.

* * * * *